US005748204A

United States Patent [19]

Harrison

[11] Patent Number: 5,748,204

[45] Date of Patent: May 5, 1998

[54] HYBRID IMAGING SYSTEM CAPABLE OF USING INK JET AND THERMAL DYE TRANSFER IMAGING TECHNOLOGIES ON A SINGLE IMAGE RECEIVER

[75] Inventor: Daniel J. Harrison, Pittsford, N.Y.

[73] Assignee: Eastman Kodak Company, Rochester, N.Y.

[21] Appl. No.: 639,582

[22] Filed: Apr. 29, 1996

[51] Int. Cl.[6] ..... B41J 2/01; B41J 2/325; B41J 2/485

[52] U.S. Cl. ..... 347/2; 106/31.27; 347/100; 347/105; 347/217; 400/82; 428/195; 503/227

[58] Field of Search ..... 347/2, 100, 105, 347/96, 217, 5; 400/82; 106/31.27; 428/195, 914; 503/227

[56] References Cited

U.S. PATENT DOCUMENTS

| | | | |
|---|---|---|---|
| 4,137,042 | 1/1979 | Defago et al. | 8/2.5 A |
| 4,880,769 | 11/1989 | Dix et al. | 503/227 |
| 5,049,904 | 9/1991 | Nakamura et al. | 347/49 X |
| 5,373,350 | 12/1994 | Taylor et al. | 347/3 X |
| 5,534,479 | 7/1996 | Shuttleworth | 503/227 |
| 5,570,451 | 10/1996 | Sakaizawa | 347/4 |

OTHER PUBLICATIONS

K. Ventataraman ed., The Chemistry of Synthetic Dyes, vol. IV, p. 161, Academic Press, 1971.

*Primary Examiner*—Joseph W. Hartary
*Attorney, Agent, or Firm*—Milton S. Sales

[57] ABSTRACT

A hybrid imaging system is capable of using both ink jet technology and thermal dye transfer technology for producing images on a dye-receiving element of the type having a support and a polymeric dye image-receiving layer that contains an organic acid capable of reprotonating the deprotonated cationic dye from both ink jet ink and dye-donor ribbon. The imaging system includes a print path adapted to accept such a dye-receiving element, and a dye-receiving element transport mechanism adapted to advance a dye-receiving element along the print path. An ink jet imaging assemblage is located along the print path for selectively producing images on the dye-receiving element using ink jet inks having a dye dispersed in an aqueous ink, the dye being a deprotonated cationic dye which is capable of being reprotonated to a cationic dye having an N-H group which is part of a conjugated system. A thermal dye transfer imaging assemblage is located along the print path for selectively producing images on the dye-receiving element using thermal dye transfer technology and a dye-donor element.

7 Claims, 1 Drawing Sheet

HYBRID IMAGING SYSTEM CAPABLE OF USING INK JET AND THERMAL DYE TRANSFER IMAGING TECHNOLOGIES ON A SINGLE IMAGE RECEIVER

CROSS-REFERENCE TO RELATED APPLICATION

Reference is made to commonly assigned, U.S. patent application Ser. No. 08/469,248 entitled "Thermal Dye Transfer System With Receiver Containing An Acid Moiety", filed Jun. 6, 1995, in the names of Shuttleworth et al., now U.S. Pat. No. 5,534,479.

BACKGROUND OF THE INVENTION

1. Technical Field

This invention relates generally to digital hard copy imaging systems, including printer and image receivers; and more particularly to such printing systems that are suitable for producing images on a common image receiver using both ink jet and thermal dye transfer technologies.

2. Background Art

Conventional non-impact imaging systems can be classified by technologies into several categories, which include both ink jet technology and thermal dye transfer technology.

Ink jet imaging systems, in which an ink jet print head is made up of a set of ink jet nozzles combined with an ink source, have an advantage that the print face is clear and sharp. Accordingly, ink jet technology is a good choice for producing high quality text images. Generally, ink jet technology imaging systems do not require special image receivers, and therefore fairly inexpensive receiver elements such as ordinary office paper may be employed. However, ink jet technology imaging systems are considered to be slow when required to produce gray scale pictorial images because of known limitations of bit depth and limited number of drop sizes and drop rate.

On the other hand, thermal dye transfer technology imaging systems are recognized as being excellent at producing gray scale pictorial images, but poor when it comes to producing high quality text images.

While it would seem natural to provide a hybrid imaging system combining both ink jet technologies and thermal dye transfer technologies, this has evaded skilled workers in the art because of what was previously the mutual exclusivity of characteristics required by the image receivers of the two technologies.

Ink jet receiver elements are often simply plain paper or coated paper designed to accept aqueous-based inks. On the other hand, resistive head thermal dye transfer technology relies upon dye diffusion out of a resinous donor layer and into a resinous receiver layer of the receiver element such as disclosed in commonly assigned, U.S. patent application Ser. No. 08/469,248 entitled "Thermal Dye Transfer System With Receiver Containing An Acid Moiety", filed Jun. 6, 1995, in the names of Shuttleworth et al., now U.S. Pat. No. 5,534,479. Such receiver elements have a polymeric dye absorber resin coating. These resins are typically polycarbonates, polyesters, and polyvinyl chlorides; and generally have little or no water solubility. Thus, their ability to absorb aqueous ink jet inks has been hampered. Accordingly, no single image receiver technology has been available for both ink jet and thermal dye transfer technologies.

This is not to say that both technologies have not been combined within a single printer. U.S. Pat. No. 5,049,904, which issued to Nakamura et al. on Sep. 17, 1991, discloses a printer devised so as to function both as a thermal printer and as an ink jet printer. However, the removable print heads of each technology are not usable at the same time (with the same image receiver). There is no teaching in Nakamura et al. of a single receiver that would be suitable for use in an imaging system of both technologies.

Dyes for non-impact print imaging should have bright hue, good solubility in coating solvents, good transfer efficiency and good light stability. An image receiver should have good affinity for the dye and provide a stable (to heat and light) environment for the dye after transfer. In particular, the transferred dye image should be resistant to damage caused by handling, or contact with water and other chemicals or other surfaces such as the back of other prints, adhesive tape, and plastic folders, generally referred to as "retransfer".

U.S. Pat. No. 4,880,769 describes the thermal transfer of a neutral, deprotonated form of a cationic dye to a receiver element. The receiver element is described as being a coated paper, in particular organic or inorganic materials having an "acid-modified coating". The inorganic materials described are materials such as an acidic clay-coated paper. The organic materials described are "acid-modified polyacrylonitrile, condensation products based on phenol/formaldehyde, certain salicylic acid derivatives and acid-modified polyesters, the latter being preferred." The "acid-modified polyester" is obtained by an image being transferred to a polyester-coated paper, and then the paper is treated with acidic vapor to reprotonate the dye on the paper.

DISCLOSURE OF THE INVENTION

It is an object of the present invention to provide a hybrid imaging system, including imager and image receiver, capable of using ink jet and thermal dye transfer technologies for producing images on a common image receiver element.

It is another object of the present invention to provide a dual imaging system employing a dye-receiver having an acidic dye image-receiving layer which upon transfer of the dye forms a dye/counterion complex which is substantially immobile, which would reduce the tendency to re-transfer to unwanted surfaces.

It is still another object of this invention to provide a dual ink jet and thermal dye transfer imaging system employing a dye-receiver having an acidic dye image-receiving layer without having to use a post-treatment fuming step with acidic vapors.

It is a further object of the present invention to provide a dye receiver which can accept deprotenated cationic dyes from both a resistive head dye-donor ribbon and an ink jet print head.

According to these and other objects, a feature of the present invention includes a hybrid imaging system capable of using both ink jet technology and thermal dye transfer technology for producing images on a dye-receiving element of the type having a support and a polymeric dye image-receiving layer that contains an organic acid capable of reprotonating the deprotonated cationic dye from both ink jet ink and dye-donor ribbon. The imaging system includes a print path adapted to accept such a dye-receiving element, and a dye-receiving element transport mechanism adapted to advance a dye-receiving elements along the print path. An ink jet imaging assemblage is located along the print path for selectively producing images on the dye-receiving element using ink jet inks having a dye dispersed in an aqueous ink.

the dye being a deprotonated cationic dye which is capable of being reprotonated to a cationic dye having an N-H group which is part of a conjugated system. A thermal dye transfer imaging assemblage is located along the print path for selectively producing images on the dye-receiving element using thermal dye transfer technology and a dye-donor element.

In a preferred embodiment of the present invention, the dye-donor element includes a support and a dye layer on the support with a dye dispersed in a polymeric binder, the dye being a deprotonated cationic dye which is capable of being reprotonated to a cationic dye having a N-H group which is part of a conjugated system. Further, according to the preferred embodiment of the present invention, the polymeric dye image-receiving layer contains an organic acid, such as a sulfonic acid, a carboxylic acid, a phosphonic acid, a phosphoric acid or a phenol as part of the polymer chain, or contains a separately added organic acid. The polymeric dye image-receiving layer acts as a matrix for the deprotonated dye and the acid functionality within the dye image-receiving layer will concurrently cause reprotonation and regeneration of the parent cationic dye without the need of any additional process step. The dye receiver is also capable of absorbing aqueous ink jet ink.

In the preferred embodiment of the invention, the deprotonated cationic dye which is capable of being reprotonated to a cationic dye having a N-H group which is part of a conjugated system has the following equilibrium structure:

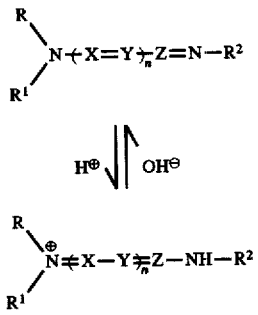

wherein:

X, Y and Z form a conjugated link between nitrogen atoms selected from CH, C-alkyl, N, or a combination thereof, the conjugated link optionally forming part of an aromatic or heterocyclic ring;

R represents a substituted or un-substituted alkyl group from about 1 to about 10 carbon atoms;

$R^1$ and $R^2$ each individually represents substituted or un-substituted phenyl or a substituted or un-substituted alkyl group from about 1 to about 10 carbon atoms; and n is 0 to 11.

Organic acids which can be separately added to the polymer to provide its acidic nature generally comprise ballasted organic acids, e.g., carboxylic acids such as palmitic acid, 2-(2,4-di-tert-amylphenoxy)butyric acid, etc.; phosphonic/phosphoric acids such as monolauryl ester of phosphoric acid, dioctyl ester of phosphoric acid, dodecylphosphonic acid, etc.; sulfonic acids such as hexadecanesulfonic acid, p-octyloxybenzenesulfonic acid; a phenol such as 3,5-di-tert-butyl-salicylic acid, etc.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together; provided such polymeric material contains acid groups either as part of the polymer chain or as a separately added organic acid. The polymeric acid containing dye receiver layer must absorb both aqueous ink jet inks and dye transferred from a dye-donor ribbon.

The invention, and its objects and advantages, will become more apparent in the detailed description of the preferred embodiments presented below.

BRIEF DESCRIPTION OF THE DRAWING

In the detailed description of the preferred embodiments of the invention presented below, reference is made to the accompanying drawing, in which the figure is a schematic view of a hybrid imaging system capable of using ink jet and thermal dye transfer imaging technologies on a single image receiver.

BEST MODE FOR CARRYING OUT THE INVENTION

Figure 1:
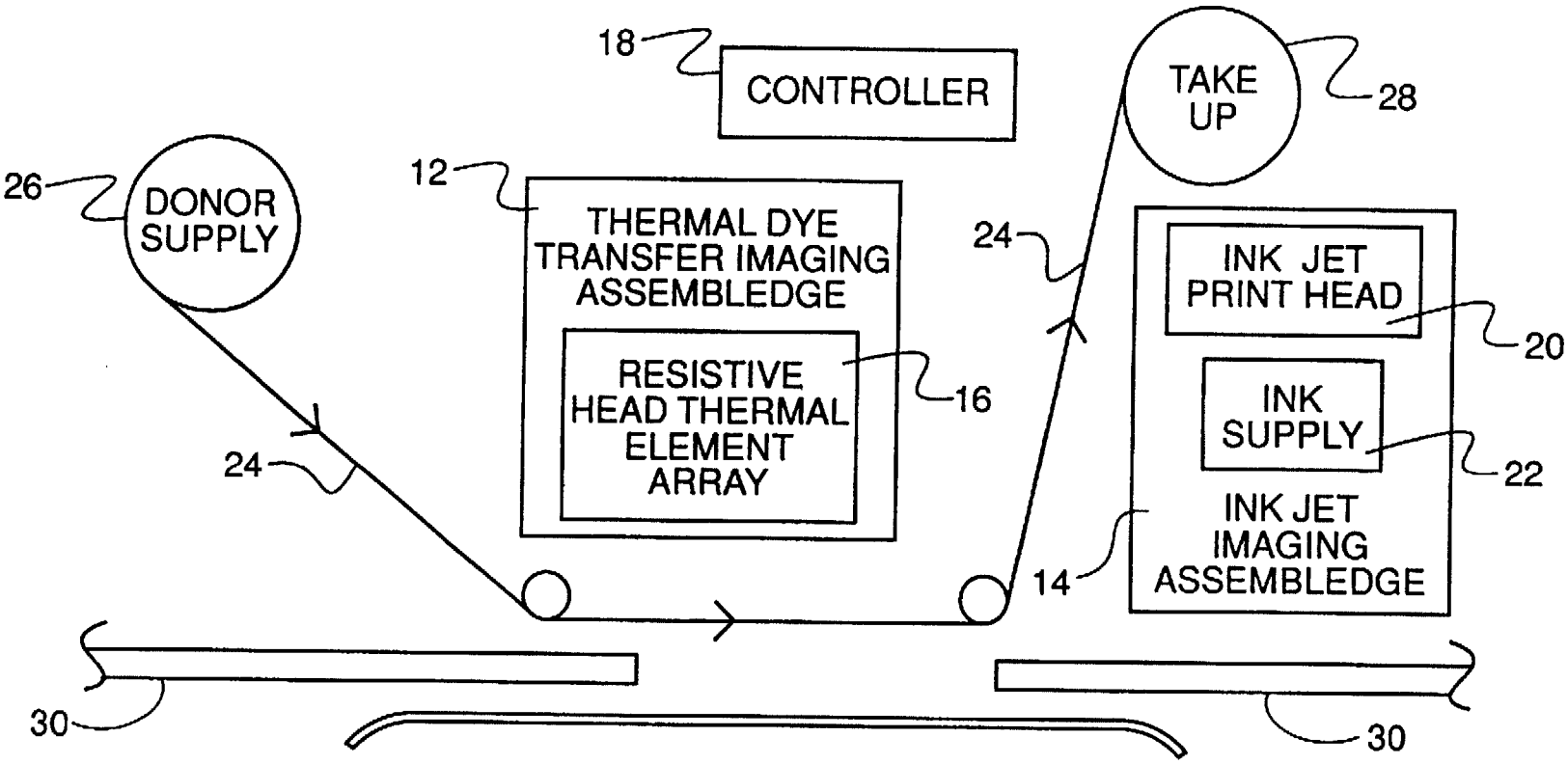

The present description will be directed, in particular, to elements forming part of, or cooperating more directly with, apparatus in accordance with the present invention. It is to be understood that elements not specifically shown or described may take various forms well known to those skilled in the art.

Referring to the figure, a printer 10 includes both a thermal dye transfer imaging assemblage 12 and an ink jet imaging assemblage 14. The thermal dye transfer imaging assemblage and an ink jet imaging assemblage can operate either independently or together to transfer deprotinated cationic dyes to a common dye receiver element in an image wise fashion. Thermal dye transfer imaging assemblage 12 includes, for example, a resistive head thermal element array 16 and an associated controller 18. Ink jet imaging assemblage 14 includes, for example, an ink jet print head 20, an ink supply 22, and an associated controller; shown as being common with controller 18.

A ribbon of dye-donor material 24 is movable from a supply roll 26 to a take-up roll 28. The printer must be able to reposition the dye receiver element 30 such that multiple colors of dye (i.e., cyan, magenta, yellow, black) can be applied so that full color images, continuous tone color images, and/or graphics can be formed on the receiver.

According to a feature of the present invention, it has been recognized that a dye-receiving element comprising a support having thereon a polymeric dye image-receiving layer, the dye-receiving element being in a superposed relationship with either the dye-donor element so that the dye layer is in contact with the dye image-receiving layer, or the ink jet head so that the ink can be applied in an imagewise pattern, or both, the dye image-receiving layer containing an organic acid which is capable of reprotonating the deprotonated cationic dye from both the ink jet or dye-donor ribbon.

Thus, a dual imaging media assemblage according to an illustrative embodiment of the present invention includes a dye-donor element support having thereon a dye layer comprising a dye dispersed in a polymeric binder. The dye is a deprotonated cationic dye which is capable of being reprotonated to a cationic dye having a N-H group which is part of a conjugated system.

An ink jet ink has a dye dispersed in an aqueous ink. The dye is a deprotonated cationic dye which is capable of being reprotonated to a cationic dye having an N-H group which is part of a conjugated system.

A dye-receiving element support has thereon a polymeric dye image-receiving layer. The dye-receiving element is in a superposed relationship with either the dye-donor element so that the dye layer is in contact with the dye image-receiving layer, or the ink jet head so that the ink can be applied in an imagewise pattern, or both. The dye image-receiving layer contains an organic acid which is capable of reprotonating the deprotonated cationic dye from both the ink jet or dye-donor ribbon.

Preferably, the polymeric dye image-receiving layer contains an organic acid, such as a sulfonic acid, a carboxylic acid, a phosphonic acid, a phosphoric acid or a phenol as part of the polymer chain, or contains a separately added organic acid. The polymeric dye image-receiving layer acts as a matrix for the deprotonated dye and the acid functionality within the dye image-receiving layer will concurrently cause reprotonation and regeneration of the parent cationic dye without the need of any additional process step. The dye receiver is also capable of absorbing aqueous ink jet ink.

The deprotonated cationic dye employed is capable of being reprotonated to a cationic dye having a N-H group which is part of a conjugated system has the following equilibrium structure:

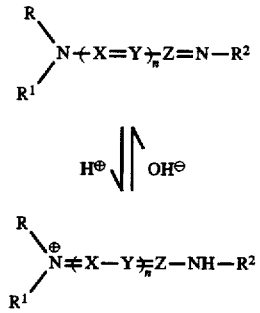

wherein:

1. X, Y and Z form a conjugated link between nitrogen atoms selected from CH, C-alkyl, N, or a combination thereof, the conjugated link optionally forming part of an aromatic or heterocyclic ring;
2. R represents a substituted or un-substituted alkyl group from about 1 to about 10 carbon atoms;
3. $R^1$ and $R^2$ each individually represents substituted or un-substituted phenyl or a substituted or un-substituted alkyl group from about 1 to about 10 carbon atoms; and
4. n is 0 to 11.

Cationic dyes according to the above formula are disclosed in U.S. Pat. Nos. 4,880,769 and 4,137,042, and in K. Venkataraman ed., *The Chemistry of Synthetic Dyes*, Vol. IV, p. 161, Academic Press, 1971, the disclosures of which are hereby incorporated by reference.

Organic acids which can be separately added to the polymer to provide its acidic nature generally comprise ballasted organic acids, e.g., carboxylic acids such as palmitic acid, 2-(2,4-di-tert-amylphenoxy)butyric acid, etc.; phosphonic/phosphoric acids such as monolauryl ester of phosphoric acid, dioctyl ester of phosphoric acid, dodecylphosphonic acid, etc.; sulfonic acids such as hexadecanesulfonic acid, p-octyloxybenzenesulfonic acid; a phenol such as 3,5-di-tert-butyl-salicylic acid, etc.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together; provided such polymeric material contains acid groups either as part of the polymer chain or as a separately added organic acid. The polymeric acid containing dye receiver layer must absorb both aqueous ink jet inks and dye transferred from a dye-donor ribbon.

The invention has been described in detail with particular reference to preferred embodiments thereof, but it will be understood that variations and modifications can be effected within the spirit and scope of the invention.

What is claimed is:

1. A hybrid imaging system capable of using both ink jet technology and thermal dye transfer technology for producing images on a dye-receiving element of the type having a support and a polymeric dye image-receiving layer that contains an organic acid capable of reprotonating the deprotonated cationic dye from both ink jet ink and dye-donor ribbon; said printer comprising:

means for defining a print path adapted to accept such a dye-receiving element;

a dye-receiving element transport mechanism adapted to advance a dye-receiving elements along the print path;

an ink jet imaging assemblage located along the print path for selectively producing images on the dye-receiving element using ink jet inks having a dye dispersed in an aqueous ink, the dye being a deprotonated cationic dye which is capable of being reprotonated to a cationic dye having an N-H group which is part of a conjugated system;

a thermal dye transfer imaging assemblage located along the print path for selectively producing images on the dye-receiving element using thermal dye transfer technology and a dye-donor element; and control means for controlling imaging of image data by the ink jet imaging assemblage and the thermal dye transfer imaging assemblage on the dye-receiving element.

2. A hybrid imaging system as set forth in claim 1 wherein said dye-donor element comprises:

a support; and a dye layer on the support with a dye dispersed in a polymeric binder, the dye being a deprotonated cationic dye which is capable of being reprotonated to a cationic dye having a N-H group which is part of a conjugated system.

3. A hybrid imaging system as set forth in claim 1 wherein the deprotonated cationic dye which is capable of being reprotonated to a cationic dye having a N-H group which is part of a conjugated system has the following equilibrium structure:

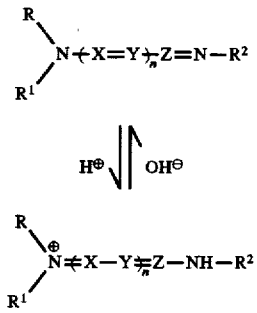

where:

X, Y and Z form a conjugated link between nitrogen atoms selected from CH, C-alkyl, N, and a combination thereof;

R represents a substituted or un-substituted alkyl group from about 1 to about 10 carbon atoms;

$R^1$ and $R^2$ each individually represents phenyl or an alkyl group from about 1 to about 10 carbon atoms; and n is 0 to 11.

4. A hybrid imaging system as set forth in claim 3 wherein the conjugated link forms part of an aromatic ring.

5. A hybrid imaging system as set forth in claim 3 wherein the conjugated link forms part of a heterocyclic ring.

6. A hybrid imaging system, including printer and media, capable of using both ink jet technology and thermal dye transfer technology for producing images on an image receiving element; said imaging system comprising:

a supply of media of the type having (i) a dye-donor element and (ii) a dye-receiving element of the type having a support and a polymeric dye image-receiving layer that contains an organic acid capable of reprotonating the deprotonated cationic dye from both the ink jet or dye-donor ribbon;

means for defining a print path;

a media transport adapted to advance the dye-receiving element along the print path;

an ink jet imaging assemblage located along the print path for selectively producing images on the dye-receiving element using ink jet inks having a dye dispersed in an aqueous ink, the dye being a deprotonated cationic dye which is capable of being reprotonated to a cationic dye having an N-H group which is part of a conjugated system;

a thermal dye transfer imaging assemblage located along the print path for selectively producing images on the dye-receiving element using thermal dye transfer technology; and control means for controlling printing of image data by the ink jet imaging assemblage and the thermal dye transfer imaging assemblage on the dye-receiving element.

7. A hybrid imaging system as set forth in claim 6 wherein said dye-donor element comprises:

a support; and a dye layer on the support with a dye dispersed in a polymeric binder, the dye being a deprotonated cationic dye which is capable of being reprotonated to a cationic dye having a N-H group which is part of a conjugated system.

* * * * *

IN THE UNITED STATES PATENT AND TRADEMARK OFFICE

CERTIFICATE OF CORRECTION

PATENT NO.: 5,748,204
DATED: May 5, 1998
INVENTOR(S): Daniel J. Harrison It is certified that an error appears in the above-identified patent and that said Letters Patent is hereby corrected as shown below:

ON THE TITLE PAGE:

Add --[60] Related U.S. Application Data; Provisional Application No. 60/004,064, September 20, 1995—

Signed and Sealed this

Twenty-second Day of February, 2000

*Attest:*

Q. TODD DICKINSON

*Attesting Officer*

*Commissioner of Patents and Trademarks*